US005645403A

United States Patent [19]

Bogage

[11] Patent Number: 5,645,403

[45] Date of Patent: Jul. 8, 1997

[54] METAL CONTOURED BLADE WITH ROLLED EDGES AT IMPACT SURFACES

[76] Inventor: Gerald I. Bogage, 2245 NW. 72nd Ave., Miami, Fla. 33122

[21] Appl. No.: 601,611

[22] Filed: Feb. 14, 1996

[51] Int. Cl.[6] ..... F04D 29/38

[52] U.S. Cl. ..... 416/235; 416/5; 416/DIG. 3

[58] Field of Search ..... 416/5, 235, 170 R, 416/236 R, 243, 244 R, DIG. 3; 29/889.6, 889.7, 889.71; 417/423.15, 424.1; D23/377, 379, 385, 411, 413

[56] References Cited

U.S. PATENT DOCUMENTS

| | | | |
|---|---|---|---|
| 1,506,937 | 9/1924 | Miller . | |
| 1,818,607 | 8/1931 | Campbell . | |
| 2,175,609 | 10/1939 | Leeb | 416/235 |
| 3,174,681 | 3/1965 | Monroe . | |
| 3,609,055 | 9/1971 | Luff et al. . | |
| 4,342,073 | 7/1982 | Ranten | 416/5 |
| 4,592,702 | 6/1986 | Bogage | 416/5 |
| 4,634,345 | 1/1987 | Stanek et al. | 416/170 R |
| 4,892,460 | 1/1990 | Volk . | |

*Primary Examiner*—Edward K. Look
*Assistant Examiner*—Christopher Verdier
*Attorney, Agent, or Firm*—Hoffman, Wasson & Gitler, P.C.

[57] ABSTRACT

A ceiling fan is disclosed as including a motor and a plurality of fan blades, each of which is a contoured metal blade. Each fan blade has an enlarged leading edge and an end edge, which have been rolled over to establish a thickness of three-sixteenths of an inch at the forward, or "impact" side. Such thickness meets the recognized industry safety standard for fans used in low height applications, wherein the fan is secured to a ceiling spaced eight feet above the floor, and the fan blades are suspended from a depending shaft at an elevation of seven feet above the floor. Such unique arrangement allows high velocity, contoured metal fan blades to be used in applications formerly reserved for wooden paddle fans with blade thicknesses of at least three-sixteenths of an inch.

3 Claims, 1 Drawing Sheet

METAL CONTOURED BLADE WITH ROLLED EDGES AT IMPACT SURFACES

BACKGROUND OF THE INVENTION

1. Field of the Invention

The present invention is directed generally to ceiling fans with metal contoured blades for controlling the direction of the air flow. More specifically, the present invention is directed to metal contoured blades utilizing rolled back edges to comply with accepted safety standards for ceiling fans.

2. Description of Prior Art

Many contoured blades are well known in the art of propeller and air blades as used in connection with water craft, air exhaust fans and air circulating floor fans. The prior art is exemplified by U.S. Pat. Nos. 1,506,937; 3,609,055; 3,124,681; 4,892,460; and 1,818,607. However, none of the above patents discloses the specific metal fan with a special contour as constituted by applicant's invention. By way of example U.S. Pat. No. 4,892,460 discloses a ceiling fan having a fan blade 2 with a trailing edge to which an auxiliary blade 1 is attached; note that the auxiliary blade 1 is merely arcuate and is not contoured like applicant's invention and that this patented fan would not operate in the reverse direction, that the blade 24 is twisted at its free end 27, and that such blade does not utilize a constant contour as used by applicant.

U.S. Pat. No. 3,174,681 discloses a reversible propeller wherein each blade has an S-shaped cross section which is not constant but rather varies from the central hub to the tip thereof.

U.S. Pat. No. 2,609,055 shows a reversible propeller blade having opposite sides which are not S-shaped and which are constructed by two separate sections that are joined together.

U.S. Pat. No. 1,506,937 relates to a fan blade which is twisted along its longitudinal axis and which has a contour that is not constant but rather varies along such axis.

U.S. Pat. No. 1,818,607, granted Aug. 11, 1931, to Elba E. Campbell, discloses a fan blade comprising two metal stampings (12, 14) riveted together to form four blades (18). A central flat portion (20) serves as a hub for the fan, which may be used to cool automobile engines or the like. The forward or leading edge (24) of the blade is bent out of the plane of the flat blade, while the trailing edge (25) is bent slightly upwardly into the plane of the fan. The bent edges stiffen the fan blade, but eliminate, or at least reduce, the whistling noise of the rotating fan blade.

Whereas contoured metal blades have found widespread acceptance for use in ceiling fans employed in rooms with ceilings of approximately eight feet in height, or greater, safety considerations have precluded usage of metal fan blades in low height applications. Underwriters Laboratories established a safety standard for ceiling fans approximately twelve years ago, and such standard is predicated upon the thickness of wooden paddle fan blades, which are typically three-sixteenths of an inch thick at the forward "impact" edge of the blade.

Metal blades, be they made as flat metal stampings, or as contoured, S-shaped blades, are considerably thinner than three-sixteenths of an inch, thus the potential harmful impact of rapidly rotating metal blades upon persons and property coming into contact with the blades posed a serious safety hazard. Consequently, the safety standard established by Underwriters' Laboratories, and implemented by the ceiling fan industry, has precluded the utilization of ceiling fans with metal blades for low height applications. The wooden paddle blade fan, despite disadvantages of weight, speed, longevity of operation, etc. when compared to ceiling fans with contoured metal blades, has obtained a heretofore unchallenged domination of the ceiling fan market for low height applications.

SUMMARY OF THE INVENTION

The present invention is summarized in the combination of a ceiling fan having a plurality of metal contoured blades, which fan is adapted to be secured to a ceiling or the like; wherein each blade is metal and has contoured surfaces for directing the air flow from the blade, and possesses a rolled edge at its leading edge and end edge to absorb impact forces.

It is an object of the present invention to produce a metal contoured fan blade, with rolled edges, at strategic locations, so that such fan blade meets industry recognized safety standards previously attainable only by fans with thick wooden paddle blades.

It is another object of the present invention to produce a metal contoured fan blade, with a rolled over leading edge and a rolled over end edge, the rolled over sections being robust enough to meet the 3/16 of an inch thickness requirement, at impact surfaces, recognized as the critical safety factor.

Another object of the invention is to utilize the superior features of contoured metal fan blades, such as light weight, better control of air flow, longer motor life, etc. while meeting the safety standard for "impact" edges of fan blades.

Yet another object of the invention is to utilize the unique, contoured metal fan blades with rolled over edges in low height applications, wherein the ceiling fan is secured to an eight foot ceiling and the fan blades are secured to the depending end of a shaft at a height of seven feet, or less, from an appropriate floor.

An object of the present invention is to simplify the construction of a ceiling fan by means of a contoured metal blade to effectively direct air flow, while meeting the recognized safety standard for the leading edge of each fan blade.

DESCRIPTION OF THE PREFERRED EMBODIMENT

In this present invention, there is a combination including an overhead ceiling fan and a contoured metal blade therefor. The ceiling fan is not being described in detail, however, a similar ceiling fan is found in U.S. Pat. No. 5,135,365 dated Aug. 4, 1992 and entitled waterproof overhead fan, which patent is incorporated herein by reference in its entirety. While this patent shows a waterproof fan, the present invention is not limited to such a waterproof fan, but rather may be utilized in combination with a variety of ceiling fans.

Figure 1:
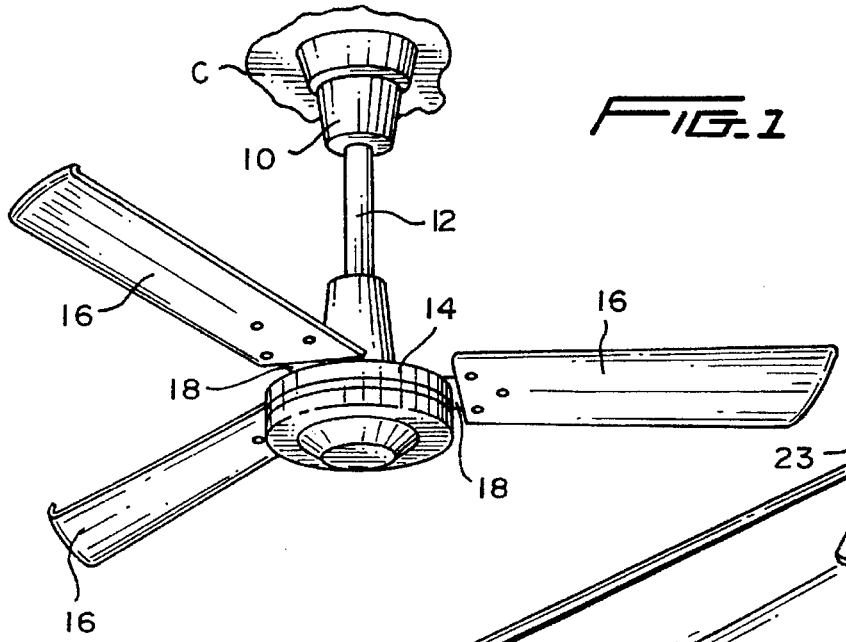
FIG. 1 is a perspective view of an overhead fan suspended from a ceiling and constructed in accordance with the present invention.

As is illustrated in FIG. 1, a ceiling fan includes an upper supporting portion 10 secured to a ceiling C by any suitable means (not shown) and a support shaft 12 leading to a lower housing 14 for a conventional electric motor. A plurality of spaced fan blades 16 (three in this instance) are fixed at their inner end to the housing 14 for rotation therewith by means of a mounting plate 18. Two cap bolts (not shown) fasten the plate 18 to the rim of housing 14 while three cap bolts (not shown) fasten the plate 18 along with three bushings (not shown) to the end portion of blade 16 which is provided with three matching holes 23 (FIG. 2).

Figure 2:
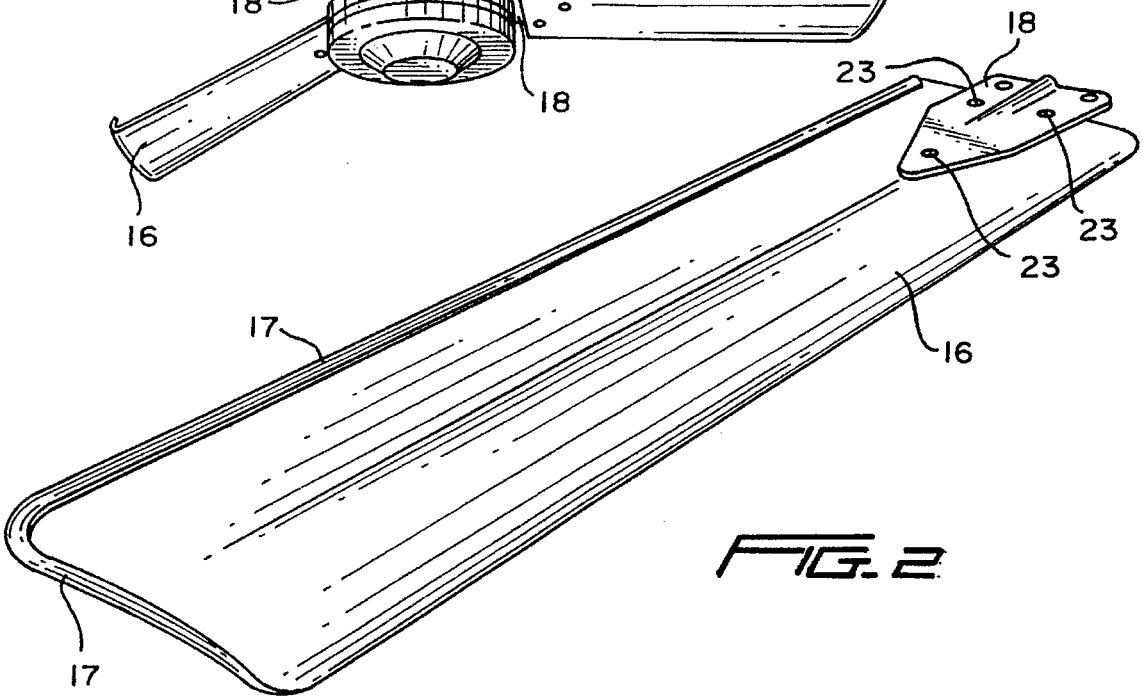
FIG. 2 is a perspective view of a contoured metal fan blade shown in FIG. 1.
Figure 3:
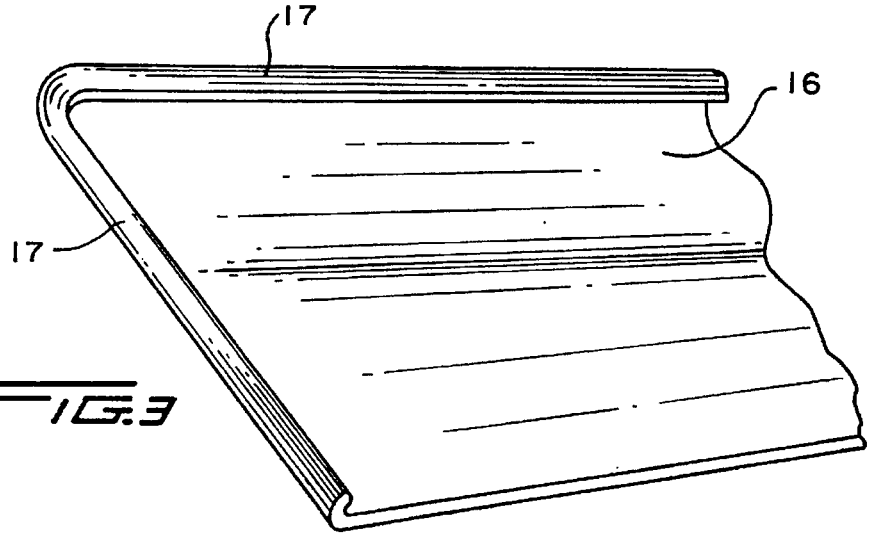
FIG. 3 is a top plan view of a portion of the blade in FIG. 2.

As shown in FIGS. 2 and 3, the metal blade 16 is a bow-shaped along the longitudinal axis of the blade. As is apparent in FIG. 2, the bow-shaped presents a contour for the metal blade 16 which is constant for the length of the longitudinal axis of the blade.

Advantages of the present invention may be realized by the following comparison of prior art fan blades and the operation of the present fan blades. A residential style fan is mounted in an 8 foot ceiling and uses a flat wooden paddle blade for directing air flow. A commercial and industrial fan operates in spacious areas with ceiling heights from 12 to 80 feet and requires a contour blade and a large motor to achieve maximum performance.

It is noted that ceiling fans are installed in rooms having ceilings of approximately 8 feet in height. The current safety standard permits ceiling fans to be suspended in applications where the height from blade to floor exceeds 8 feet provided the blade thickness is a minimum of 3/16 inch at the forward impact edge. Such safety standard was set upon the thickness of wooden paddle fan blades and virtually eliminated the use of metal blades.

Accordingly, the present invention solves the above problem by designing the edge of the metal blade to duplicate the edge of the wooden paddle, i.e., 3/16 inch. In FIGS. 2–3, the leading and end edges of the contoured metal blade 16 are each rolled back to form a 3/16 inch roll. It is recognized that a contoured aerodynamic metal blade has superior air velocity compared to a flat wooden blade design. This unique rolled edge metal blade design permits the metal high velocity blade to be used in low ceiling areas that heretofore were precluded for metal blades.

As is apparent from FIGS. 2 and 3, the metal contoured blade 16 includes a continuous rolled edge 17 along the leading edge and the end edge; the trailing edge does not have any rolled edge. The rolled edge 17 meets the 3/16 inch requirement of the existing safety standard for fans for low ceiling height installations.

Inasmuch as the present invention is subject to many variations, modifications and changes in detail, it is intended that all matter contained in the foregoing description or shown on the accompanying drawing shall be interpreted as illustrative and not in a limiting sense.

What is claimed is:

1. A ceiling fan comprising a motor and a plurality of fan blades rotated thereby, supporting means for supporting the fan from a ceiling, each fan blade being a contoured metal blade for directing air flow, each fan blade having a thickness of less than three-sixteenths of an inch, each contoured metal blade having a leading edge, a trailing edge, and an end edge that joins said leading edge to said trailing edge, and a continuous rolled edge being formed on said leading and end edges, said rolled edge being at least three sixteenths of an inch in thickness to function as an impact absorbing surface for low height applications.

2. A ceiling fan as claimed in claim 1 wherein said leading edge and said trailing edge are parallel to one another, and said end edge is perpendicular to said leading edge and said trailing edge.

3. A ceiling fan as claimed in claim 1 wherein said rolled edge is integral with the edges of said blade and is rolled back therefrom.

* * * * *